US005302482A

United States Patent [19]

Elmasry et al.

[11] Patent Number: 5,302,482

[45] Date of Patent: Apr. 12, 1994

[54] LIQUID ELECTROPHOTOGRAPHIC TONER

[75] Inventors: Mohamed A. Elmasry, Woodbury, Wash.; Kevin M. Kidnie, St. Paul; Susan K. Jongewaard, North St. Paul, both of Minn.; Gregory L. Zwadlo, Ellsworth, Wis.

[73] Assignee: Minnesota Mining and Manufacturing Company, St. Paul, Minn.

[21] Appl. No.: 652,572

[22] Filed: Feb. 8, 1991

[51] Int. Cl.[5] ..... G03G 9/00

[52] U.S. Cl. ..... 430/115; 430/112; 430/114; 430/137

[58] Field of Search ..... 430/115, 112, 114, 137

[56] References Cited

U.S. PATENT DOCUMENTS

| | | | |
|---|---|---|---|
| 3,411,937 | 11/1968 | Roteman | 430/119 |
| 3,890,240 | 6/1975 | Hochberg | 252/62.1 |
| 4,507,377 | 3/1985 | Alexandrovich | 430/115 |
| 4,564,574 | 1/1986 | Uytterhoeven et al. | 430/115 |
| 4,618,557 | 10/1986 | Dan et al. | 430/114 |
| 4,707,429 | 11/1987 | Trout | 430/115 |
| 4,798,778 | 1/1989 | El-Sayed et al. | 430/115 |
| 4,891,286 | 1/1990 | Gibson | 430/38 |
| 4,925,766 | 5/1990 | Elmasry et al. | 430/115 |
| 4,946,753 | 8/1990 | Elmasry et al. | 430/45 |
| 4,978,598 | 12/1990 | Elmasry et al. | 430/137 |
| 4,988,602 | 1/1991 | Jongewaard et al. | 430/115 |
| 5,069,995 | 12/1991 | Swidler | 430/115 |

FOREIGN PATENT DOCUMENTS

| | | |
|---|---|---|
| 0129970 | 1/1985 | European Pat. Off. . |
| 0376460 | 7/1990 | European Pat. Off. . |
| WO9014616 | 11/1990 | World Int. Prop. O. . |

*Primary Examiner*—Marion E. McCamish
*Assistant Examiner*—Rosemary Ashton
*Attorney, Agent, or Firm*—Gary L. Griswold; Walter N. Kirn; Mark A. Litman

[57] ABSTRACT

A liquid electrophotographic toner having a coordinated association of steric stabilizer and charge directing moiety displays improved characteristics when the charge directing moiety has a monovalent alkali metal or ammonium cation bonded thereto.

22 Claims, No Drawings

LIQUID ELECTROPHOTOGRAPHIC TONER

BACKGROUND OF THE INVENTION

1. Field of the Invention

This invention relates to multicolor liquid toning of electrophotographic images, and particularly to processes of liquid toner development where two or more toner images of different colors are first superimposed and then simultaneously transferred to a receptor surface.

2. Background to the Art

Early toning of electrophotographic imaging was performed with toner powders even though benefits were recognized in the use of liquid toners.

Metcalfe & Wright (U.S. Pat. No. 2,907,674) recommended the use of liquid toners for superimposed color images as opposed to the earlier dry toners. These liquid toners comprised a carrier liquid which was of high resistivity e.g., $10^{+9}$ ohm-cm or more, colorant particles dispersed in the liquid, and preferably an additive intended to enhance the charge carried by the colorant particles. Matkan (U.S. Pat. No. 3,337,340) disclosed that a first deposited toner may be sufficiently conductive to interfere with a succeeding charging step. He described the use of insulative resins (resistivity greater than $10^{-10}$ ohm-cm of low dielectric constant (less than 3.5) covering each colorant particle. York (U.S. Pat. No. 3,135,695) disclosed toner particles stably dispersed in an insulating aliphatic liquid, the toner particles comprising a charged colorant core encapsulated by a binder of an aromatic soluble resin treated with a small quantity of an aryl-alkyl material. The use of explicit dispersant additives to the toner dispersion is disclosed in U.S. Pat. No. 3,669,886.

The use of polyvalent metal soaps and blends thereof for improved liquid toner conductivity characteristics is disclosed by Hochberg (U.S. Pat. No. 3,890,240). The characteristics included latititude in concentration addition of the charging agents and improved density uniformity. The application was for liquid toners used in electrostatic photocopying. U.S. Pat. No. 4,707,429 described polyvalent metal soaps which are dispersed with thermoplastic resin binders for improved imaging characteristics by affecting the charge direction.

In U.S. Pat. No. 4,891,286 liquid toner mobility was found to be increased by the addition of insoluble monomeric organic acids and this was found most advantageous for high speed copying purposes. The toner particles described were negatively charged particles. U.S. Pat. No. 4,026,789 teaches the use of a variety of carrier soluble organic acids that enhance the positive charge of toner particles.

Improvements in copier performance have been described in U.S. Pat. No. 3,681,243 when the liquid toner contains at least one of the groups consisting of metal dialkyldithio-phosphates, sodium alkyl-phosphates, alkyl phosphates, alkali metal-alkyl sulphates, alcohols, monocarboxylic acids, phthalic acid, alkyl phthalates, ammonia, amines, aldehydes, and styrene.

The advantages of using binders comprising organosols (sometimes described as amphipathic particles) are disclosed in patents assigned to Philip A. Hunt Chemical Corp. (U.S. Pat. No. 3,753,760, U.S. Pat. No. 3,900,412, U.S. Pat. No. 3,991,226). Amongst the advantages is a substantial improvement in the dispersion stability of the liquid toner. The organosol is sterically stabilized with a graft copolymer stabilizer, the anchoring groups for which are introduced by the esterification reaction of an epoxy (glycidyl) functional group with an ethylenically unsaturated carboxylic acid. The catalyst used for the esterification is lauryldimethylamine or any tertiary amine. A similar treatment is found in U.S. Pat. No. 4,618,557 assigned to Fuji Photo Film Co., except that they claim a longer linking chain between the main polymer and the unsaturated bond of the stabilizing moiety. The comparative examples with the Hunt toners show improved image quality found over the Hunt toners due to image spread. They ascribe the improvement to the use of the longer linking chains. In both the Hunt and the Fuji patents charge director compounds, when used, are only physically adsorbed to the toner particles.

Diameters of toner particles in liquid toners vary from a range of 2.5 to 25.0 microns in U.S. Pat. No. 3,900,412 to values in the sub-micron range in U.S. Pat. No. 4,032,463, U.S. Pat. No. 4,081,391, and U.S. Pat. No. 4,525,446, and are even smaller in a paper by Muller et al, "Research into the Electrokinetic Properties of Electrographic Liquid Developers", V. M. Mueller et al, IEEE Transactions on Industry Applications, vol IA-16, pages 771-776 (1980). It is stated in U.S. Pat. No. 4,032,463 that the prior art makes it clear that sizes in the range 0.1 to 0.3 microns are not preferred, because they give low image densities.

Liquid toners that provide developed images which rapidly self-fix to a smooth surface at room temperature after removal of the carrier liquid are disclosed in U.S. Pat. No. 4,480,022 and U.S. Pat. No. 4,507,377. These toner images are said to have higher adhesion to the substrate and to be less liable to crack. No disclosure is made of the use in multicolor image assemblies.

In the toners disclosed in the U.S. Pat. No. 3,753,760, U.S. Pat. No. 3,900,412, U.S. Pat. No. 3,991,226 (the Hunt patents), the presence of a few parts per million of a tertiary amine in the liquid toner medium produces toners with very high conductivity especially when the toner is charged with a metal soap. This causes flow of the toner during imaging which in turn degrades the image. The high conductivity is derived from the protonation of the tertiary amine groups by the unsaturated carboxylic acid groups, thus giving ionic carriers in the liquid. Another problem associated with the use of tertiary amine is the high background in the non-imaged areas which is the result of negatively charged or non-charged particles. The esterification reaction of the glycidyl groups and the carboxylic groups usually does not go to completion under the reaction conditions for making the organosol. The examples in these patents show that between 25% to 50% of the carboxylic acid groups could be esterified. In other words about 50% to 75% of the carboxylic acid still remain in the dispersion medium. During the dispersion polymerization reaction for making the latex, the unreacted unsaturated acid can copolymerize with either the core part of the particle or the stabilizer polymer or both at the same time. The tertiary amine also may become attached onto the polymer particle by hydrogen abstraction. The presence of carboxylic acid on the particle and tertiary amine in the liquid medium or on the particle would be expected to result in the formation of carboxylic anions on the particle which is a good source for a negative charge.

These problems have been eliminated from our toner through the use of a suitable catalyst other than tertiary amines or the use of other anchoring adducts that can be catalyzed with catalysts other than tertiary amines.

U.S. Pat. No. 4,618,557 draws attention to the poor performance of the prior art (Hunt) toners and relates it to the number of carbon atoms in the linking chain. We have found that the use of a tertiary amine catalyst for attaching an unsaturated group to the main chain of the stabilizing resin via linking groups is the main reason for the poor performance of Hunt's liquid developers. It is believed therefore that the liquid developers of U.S. Pat. No. 4,618,557 showed better quality images compared with Hunt's because they do not use a tertiary amine catalyst, rather than the claimed use of long linking groups. However, that patent failed to disclose anything related to the present invention. Toners according to the present invention are superior to the toners of U.S. Pat. No. 4,618,557 for these reasons:

a) The prior art patent uses zirconium naphthenate as the charge director for their liquid toners. The metal cation is physically adsorbed onto the dispersed particles. This method usually results in a charge decay with time due to the gradual desorption of the metal soap from the particles. Toners according to the present invention do not suffer a charge decay because they are charged with metal chelate groups chemically attached to the resin particles.

b) U.S. Pat. No. 4,618,557 uses mercury acetate, tetrabutoxy titanium or sulfuric acid as catalyts for the anchoring reaction. Some of the substances are toxic (such as mercury acetate) and must be removed from the toner. However, the patent uses subsequent steps to remove the catalysts by precipitation from a non-solvent such as acetonitrile or methanol. These solvents may be trapped in the stabilizing polymer and are very difficult to remove. The present invention selectively chooses catalysts and reactants so that there is no need for the purification step.

The toners disclosed in U.S. Pat. No. 4,564,574 are based on chelating polymers containing cationic groups neutralized with counter anions as the source of the charge. The polymer may be a homopolymer, copolymer, block copolymers or graft copolymer comprising a coordinating compound bound to the backbone of the polymer. The chelating polymer is prepared in solution by a free radical polymerization reaction (using DMF as the solvent). After precipitating the polymer and redissolving it in a suitable solvent (THF), it is allowed to react with a metal cation. Those toners are prepared by milling a solution of the polymer in a suitable solvent (THF) with a pigment. The ratio of pigment to polymer is 1:4. Through this process, the polymer is adsorbed onto the surface of the pigment particles. Finally the blend is diluted with Isopar TM G to the proper concentration.

The polymers of U.S. Pat. No. 4,564,574 are prepared in a liquid medium which is a good solvent for the polymer, whereas our chelate polymers, are prepared by dispersion polymerization techniques wherein the liquid medium is not a good solvent for the dispersed polymeric particles. It is also well known that conducting a metal chelate reaction of a transition metal cation and a polymer containing coordinating groups in a liquid, which is a good solvent for the polymer, results in the formation of a crosslinked metal chelate gel. Some coordinating compound groups can lose a proton when they form ligands with a transition metal cation. This proton can neutralize the anion of the metal cation, thus reducing the overall charge of the material, which would be expected in the practice of the technology of that patent. The resulting metal chelate complex does not dissociate in a hydrocarbon solvent system.

Also, that patent claims that the use of a coordination compound in combination with any neutralizing anion such as halide, sulfate, p-toluenesulfonate, $ClO4^-$, $PF6^-$, $TaF6^-$ or any relatively large anion, would improve the dissociation of the corresponding ion pair in an apolar medium. Transition metal complexes or salts of these anions usually do not dissolve in a hydrocarbon liquid such as Isopar TM G. It is not apparent how they could dissociate in such a non-solvent system to give the charge on the particles necessary for good electrostatic imaging. The physical results in practice, showing low Zeta potentials for toner according to that invention, substantiate this analysis.

The toners of the present invention are based on polymer dispersions which are prepared by dispersion polymerization techniques in an aliphatic hydrocarbon liquid. The polymer dispersion consists of pendant chelate groups attached to the soluble polymeric component of the particle. This component consists of a graft copolymer stabilizer containing metal chelate groups. The stabilizer polymer is chemically anchored to the insoluble part of the polymer (the core). Since these particles are in constant movement, cross-linking through the metal complex would be very difficult. In some cases cross-linking may take place in latices with high solid contents (>10%) due to the close distance between the particles. However, in latices with solid contents of less than 10%, cross-linking does not occur and the 1:1 complex is formed. In such a case only one counter ion (anion) of the metal salt is neutralized, while the other anions are still bound to the transition metal atom and dissociate in a hydrocarbon liquid. The new metal chelate latices of the present invention have been found to dissociate in a hydrocarbon liquid to give a high charge on the dispersed particle.

In U.S. Pat. No. 4,798,778 a liquid electrostatic developer containing modified resin particles are described. Also described are several procedures for preparation of the liquid developers which contain the resin particles.

The resin particles consist primarily of ethylene homopolymers or copolymers with certain types of esters, where the esters have certain substituents, e.g., hydroxyl, carboxyl amine, and acid halide. The resin particles once formed have an average particle size of less than 10 um.

The process for preparation of developers with the resins include mixing with the nonpolar fluid (Isopar TM G) at an elevated temperature to liquify the resin, cooling the formed particles, reacting the suspension with compounds selected from alkyl amine, alkyl hydroxide amino alcohol, etc., and adding charge control agents to the suspension. The resultant toners carry a net negative charge as described in U.S. Pat. No. 4,798,778.

There are several differences between the present invention and the described patent including the solubility of the added resinous material, and the polarity of the resultant liquid electrostatic developer, and the less complicated procedure of simply incorporating the described material during milling.

SUMMARY OF THE INVENTION

The present invention relates to liquid toners comprising a carrier liquid, a pigment particle and a coordinated association of steric stabilizer and charge directing moiety. In the liquid toner there is present at least 0.01 to 50 molar percent relative to the metal component of the charge directing moiety, a charge enhancing monovalent alkali metal cation or ammonium cation bonded to said charge directing moiety.

The liquid toner composition of the present invention comprises a non-polar carrier liquid having a dispersion therein of toner particles comprising:

a. a pigment particle, and b. thermoplastic polymeric particles about the surface of said pigment particle.

The polymeric particles have copolymeric steric stabilizer groups adhered to their surfaces, and the copolymeric stearic stabilizer have moieties attached thereto. These moieties comprise coordinating groups and metal soap groups that form coordinate bonds with said coordinating groups. The dispersion of toner particles in the carrier liquid must have a monovalent alkali metal cation or ammonium cation within the carrier liquid. The cation is within the carrier liquid, usually bonded to the charge directing moiety. The monovalent metal compounds may be selected from the group for example, $Li^+$, $Na^+$, $K^+$, or $NH4^+$. The counterion may be a carboxylate, ranging from two to thirty-eight carbon atoms, similarly a sulfonate or carbonate, or a hydride of the alkali metal or hydroxide (or other material). The monovalent compound may be soluble, dispersible, suspensible, or emulsifiable in the carrier liquid. It may be dissolved or dispersed with up to 20% by weight of the acid containing polyvalent metal soap and there it may further associate itself directly with the toner particles. This association may be electrical (charge attraction) or may be physical (e.g., deposited on the surface of the pigment and/or thermoplastic polymeric particles) or may be chemical (e.g., reacted onto the surface of the pigment and/or polymeric particle).

DETAILED DESCRIPTION OF THE INVENTION

Conventional commercial liquid toners constitute a dispersion of pigments or dyes in a hydrocarbon liquid together with a binder and charge control agent. The binder may be a soluble resinous substance or insoluble polymer dispersion in the liquid system. The charge control agent is usually a soap of a heavy metal for positive toners or an oligomer containing amine group such as (herein after defined as "OLOA") for negative toners. Examples of these metal soaps are: Al, Zn, Cr, Ca salts of 3,5-diisopropylsalicylic acid; Al, Cr, Zn,,Ca, Co, Fe, Mn, Va, Sn salts of a fatty acid such as octanoic acid. Typically, a very small quantity, from 0.01-2% wt/volume of the charge control agent is used in the liquid toner. However, conductivity and mobility measurements of toners, charged with any of the above metal soaps, showed a decrease in the charge/mass ratio as derived from conductivity measurements with a period of 1 to 3 weeks. For example, toners made of quinacridone pigment, stabilized with a polymer dispersion of polyvinylacetate in Isopar TM G and charged with Al (3,5-diisorpopysalicylate)$_3$ showed a conductivity of $3\times10^{-11}$ (ohm.cm)$^{-1}$ when freshly diluted with Isopar TM G to a concentration of 0.3 weight %; upon standing for two weeks the conductivity dropped to $0.2\times10^{-11}$ (ohm.cm)$^{-1}$ . Also, this toner would not overlay another cyan toner even of the same formulation.

Liquid toners are therefore not believed to be suitable for use in the production of high quality digital imaging systems for color proofing. One of the major problems associated with these toners is the flow of the toner during imaging which results in the distortion of the produced images. Another problem is the desorption of the charge-director, as well as the resinous binder, with time. Finally the commercial toners are not believed to be suitable for use in multi-color overlay printing by a single transfer process.

The color liquid developer of this invention is a polymer dispersion in a non-polar carrier liquid which combines a number of important toner characteristics. The dispersed particles comprise a thermoplastic resinous core which is chemically anchored to a graft or block copolymer steric stabilizer. Such systems are commonly called organosols. The preferred organosol system is described in previous patent filed U. S. Pat. No. 4,946,753. The core part of the particle has a Tg preferably below 25° C. so that the particles can deform and coalesce into a resinous film at room temperatures after being electrophoretically deposited onto a photoconductive substrate. Such film forming particles have been found to be useful for successive overlay of colors with greater than 90% trapping.

The stabilizer part of the particle, which is the soluble component in the dispersion medium, is an amphipathic graft or block copolymer containing covalently attached groups of a coordinating compound. The function of these groups is to form sufficiently strong covalent links with organometallic charge directing compounds such as acid containing polyvalent metal soaps so that no subsequent desorption of the charge directing compounds occurs.

This invention discloses monovalent compounds, preferably from the carboxylates class which are used as an additive to the organosol/metal chelate liquid toner. The preferred monovalent carboxylate contains an ion selected from the following non limiting groups of alkali metals, sodium, lithium, and potassium or ammonium, organic or other inorganic monovalent containing cations may be used. The carboxylate functionality is comprised of groups having two to twenty carbon atoms. The monovalent cations do not need to be soluble in the aliphatic hydrocarbon solvent, however, it is desirable to be soluble or otherwise dispersable in the organometallic charge directing compounds such as acid containing polyvalent metal soaps. The solubility of the monovalent cations with the acid containing polyvalent metal soap can be up to 20% by weight, and there it may further associate itself directly with the toner particles. This association may be electrical (charge attraction) or may be physical (e.g., deposited on the surface of the pigment and/or thermoplastic polymeric particles) or may be chemical.

The described monovalent cation, and equivalent functioning materials, apparently functions as a toner charge enhancing component when present in certain proportions to the acid containing polyvalent metal soap in the toner formulation. The range of incorporation of the, for example, carboxylate to the acid containing polyvalent metal soap additive is 0.01-50 percent with a preferred range of 0.01 to 15 percent. With the addition of the monovalent alkali metal or ammonium cation, the charging characteristics are enhanced in the toner, resulting in improved image characteristics, increased particle mobility and film conductivity.

In the compounding of the toner developer liquid according to this invention, the finely powdered colorant material is mixed with the polymer dispersion in the carrier liquid (organosol) described above, an acid containing polyvalent metal soap and a monovalent alkali metal cation or ammonium cation containing material and subjected to a further dispersion process with a high speed mixer such as a Silverson mixer to give a stable mixture. It is believed that the organosol particles agglomerate around each individual colorant particle to give stable dispersions of small particle size, the organosol and resin bringing to the combined particle its own properties of charge stability, dispersion stability, and film-forming properties.

In summary, the toners of the present invention comprise a pigment particle having on its exterior surface polymer particles usually of smaller average dimensions than said pigment particle, said polymer particles having charge carrying coordination moieties extending from the surface of said polymeric particles, acid containing polyvalent metal soaps and monovalent alkali metal or ammonium cations as charge enhancing agents. Polymeric particles in the practice of the present invention are deemed as distinct volumes of liquid, gel, or solid material and are inclusive of globules, etc, which may be produced by any of the various known techniques such as dispersion or emulsion polymerization.

A compound having a monovalent alkali metal cation or ammonium cation which will substitute said cation for a Brönsted acid hydrogen on a transition metal soap coordination species is added during various stages of the formation of the liquid toner. It is preferably added during the earliest stages of mixing the components, e.g. before the polymeric particles have surrounded the pigment particles. However, the ammonium cation or monovalent alkali cation material may be added at any stage of production with some reduced benefits as compared to the preferred time of addition, e.g., while the polymer particles have begun to surround the pigment or after the surrounding has been accomplished.

The monovalent alkali metal cation and ammonium cations should be present in said liquid toner as at least 0.05% on a molar basis as compared to the metal of the metal soap in order to display useful beneficial results. Generally it is preferred to use between 0.01 and 15% on a molar basis compared to the metal of the acid containing polyvalent soap. The most preferred range would be about 0.1 to 15% on a molar basis.

The materials which can be used to contribute the monovalent alkali metal cation or ammonium cation include, but are not limited to, monovalent alkali metal or ammonium:

1. carboxylates
2. sulfonates
3. hydrides
4. carbonates
5. hydroxides

It is important in the practice of the present invention to use monovalent alkali metal cations and not polyvalent cations. At least divalent cations ($Ca^{-2}$) are disclosed in U.S. Pat. No. 3,890,240 as additives to liquid electrophotographic toners having metal coordinate compounds acting as stearic stabilizer and charge directing compound. The monovalent alkali metal additives of the present invention display significant improvements over the polyvalent alkali metal additives of this art. The use of monovalent alkali metal cations and ammonium cations in direct comparison with the use of polyvalent alkali metal cations (e.g., $Ca^{+2}$) displayed improved trapping, reduced clouding (i.e., background imaging $D_{min}$) and overall improved image density uniformity. This is shown in part in Example 3.

It is believed that the formation of the beneficial species in the liquid toner are formed as follows. The metal soap coordinated association appears to have a Brönsted acid hydrogen attached to the metal or to an oxygen atom bonded to the metal. The monovalent alkali metal or ammonium cation replaces the Brönsted acid hydrogen and thereby alters the properties of the charge directing species. When divalent alkali metal compounds (e.g., carboxylates) are used, they have a strong tendency to complex with coordinating positions on the soap and do not as frequently replace the Brönsted acid hydrogen, although some of that reaction may well occur.

When using a monovalent carboxylate, it is to be incorporated into the organometallic charge directing compounds, such as metal soaps, and mixed well. This mixture is preferably incorporated into the toner prior to milling of the pigment. The preferred monovalent carboxylate contains the following non limiting groups sodium, lithium, potassium, or ammonium. The carboxylate functionality is comprised of groups having two to twenty carbon atoms. Examples of preferred monovalent carboxylates, sulfonates, carbonates and other monovalent metal additives.

Sodium Stearate
Lithium Stearate
Ammonium Stearate
Potassium Octoate
Sodium Hydride
Lithium Hydride
Aerosol OT-S - (Dioctyl ester of sodium sulfosuccinic acid)

The use of a monovalent alkali metal cation or ammonium carboxylate enhances the charge component for liquid electrophotographic developers resulting in improved image characteristics compared to toner formulations without the charge enhancing additives.

It has been found that liquid toners formulated from a colorant thermoplastic ester resin and a polymer dispersion in a non-polar carrier liquid, wherein metal chelate groups are chemically attached to the polymeric moiety of the particles, provide high quality images for digital color proofing. The preferred toners of the present invention may be characterized by the following properties:

1. There is charging of the dispersed particles with a charge director not subject to desorption from the particles, which consists of the combination of acid containing metal soap and the monovalent cation additives.
2. The polymeric latex particles provide fixing by film-forming at ambient temperature and thereby facilitate overprinting.
3. Dispersed particles are present in the toners which are stable to sedimentation.
4. The toner displays high electrical mobility.
5. High optical density is provided by the toner in the final image, and the toner (in particulate form) also displays high optical density.
6. A high proportion of conductivity is derived from the toner particles themselves as opposed to spurious ionic species.
7. Dried deposit of the toner is sufficiently conductive to allow discharge of the photoreceptor for deposition of a subsequent color toner (trap).

This invention provides new toners based on a complex molecule with the above characteristics which alleviate many of the defects of conventional toners.

The component parts of the toner particles are a core which is insoluble in the carrier liquid, a stabilizer which contains solubilizing components and coordinating components, a charge director which is capable of chelation with the coordinating components, monovalent carboxylate cation useful as a charge component and the colorant. These will be described below in detail.

The Core

This is the disperse phase of the polymer dispersion. It is made of a thermoplastic latex polymer with a $T_g$ less than 25° C. and is insoluble or substantially insoluble in the carrier liquid of the liquid toner. The core polymer is made in situ by copolymerization with the stabilizer monomer. Examples of monomers suitable for the core are well known to those skilled in the art and include ethylacrylate, methylacrylate, and vinylacetate.

The reason for using a latex polymer having a $T_g<25°$ C. is that such a latex can coalesce into a resinous film at room temperature. According to this invention, it has been found that the overprinting capability of a toner is related to the ability of the latex polymer particles to deform and coalesce into a resinous film during the air drying cycle of the electrophoretically deposited toner particles. The coalescent particles permit the electrostatic latent image to discharge during the imaging cycle, so another image can be overprinted. On the other hand, non-coalescent particles of the prior art retain their shape even after being air dried on the photoreceptor. The points of contact are then few compared to a homogeneous or continuous film forming latex, and as a result, some of the charges are retained on the unfused particles, repelling the next toner. Furthermore, a toner layer made of a latex having a core with a $T_g>25°$ C. may be made to coalesce into a film at room temperature if the stabilizer/core ratio is high enough. Thus the choice of stabilizer/(core+stabilizer) ratios in the range 20 wt.% to 80 wt.% can give coalescence at room temperature with core $T_g$ values in a corresponding range 25° C. to 105° C. With a core $T_g<25°$ C. the preferred range of stabilizer/(core+stabilizer) ratio is 10 to 40 wt.%.

Color liquid toners made according to this invention on development form transparent films which transmit incident light, consequently allowing the photoconductor layer to discharge, while non-coalescent particles scatter a portion of the incident light. Non-coalesced toner particles therefore result in the decreasing of the sensitivity of the photoconductor to subsequent exposures and consequently there is interference with the overprinted image.

The toners of the present invention have low $T_g$ values with respect to most available toner materials. This enables the toners of the present invention to form films at room temperature. It is not necessary for any specific drying procedures or heating elements to be present in the apparatus. Normal room temperature 19°-20° C. is sufficient to enable film forming and of course the ambient internal temperatures of the apparatus during operation which tends to be at a higher temperature (e.g., 25°-40° C.) even without specific heating elements is sufficient to cause the toner or allow the toner to form a film. It is therefore possible to have the apparatus operate at an internal temperature of 40° C. or less at the toning station and immediately thereafter where a fusing operation would ordinarily be located.

The Stabilizer

This is a graft copolymer prepared by the polymerization reaction of at least two comonomers. These comonomers may be selected from those containing anchoring groups, coordinating groups and solubilizing groups. The anchoring groups are further reacted with functional groups of an ethylenically unsaturated compound to form a graft copolymer stabilizer. The ethylenically unsaturated moieties of the anchoring groups can then be used in subsequent copolymerization reactions with the core monomers in organic media to provide a stable polymer dispersion. The prepared stabilizer consists mainly of two polymeric components, which provide one polymeric component soluble in the continuous phase and another component insoluble in the continuous phase. The soluble component constitutes the major proportion of the stabilizer. Its function is to provide a lyophilic layer completely covering the surface of the particles. It is responsible for the stabilization of the dispersion against flocculation, by preventing particles from approaching each other so that a sterically-stabilized colloidal dispersion is achieved. The anchoring and the coordinating groups constitute the insoluble component and they represent the minor proportion of the dispersant. The function of the anchoring groups is to provide a covalent link between the core part of the particle and the soluble component of the stearic stabilizer. The function of the coordinating groups is to react with a metal cation such as a cation of a acid containing polyvalent metal soap to impart a permanent positive charge on the particles. Preferred comonomers containing preferred functional groups are described in U.S. Pat. No. 4,946,753, filed Dec. 2, 1988.

The Charge Director

The metal soaps used as charge directors should be derived from metals such as acid containing polyvalent metals which form strong coordinate bonds with the chelating groups of the stabilizer. Preferred metal soaps include salts of a fatty acid with a metal chosen from the group Al, Ca, Co, Cr, Fe, Zn, and Zr. An example of a preferred acid containing polyvalent metal soap is zirconium neodecanoate (obtained from Mooney Co., with a metal content of 12% by weight).

Chelation With Metal Soaps

The reaction of latices containing coordinating groups is shown in the formula below, using acetylacetone as a representative example.

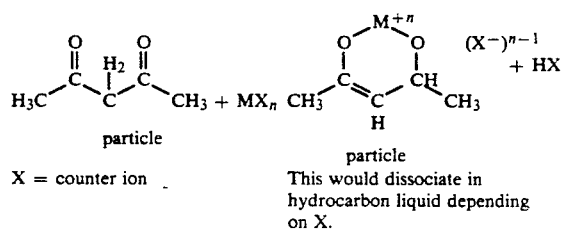

Latices containing a crown ether moiety complexed with a central metal atom such as K or Na have been found to afford toners with very high conductivity and low zeta potential. They showed flow of the toner particles during imaging. We concluded that the use of a non-transition metal complex as the source of charge for toners did not give the high charge on the particles that has been found with the use of transition metal chelate latices.

Polymer dispersions having pendant chelate groups attached to the soluble polymeric component of the particle, have been found to react with soaps of heavy metals in aliphatic-hydrocarbon liquids to form metal chelate ligands on the surface of the dispersed particles. Since these particles are in constant movement, cross-linking through the metal complex is very difficult. However, cross-linking may take place in latices with high solid contents due to the close packing of the particles and their consequent restricted movements. In a diluted system, one may speculate that intermolecular cross-linking between the stabilizer chains which are anchored to the same core may occur while intramolecular cross-linking would be very difficult. For example, when a molar equivalent of zirconium neodecanoate is added to a polymer dispersion containing a molar equivalent of pendant salicylic acid groups, a gel formation was observed and the gel could not be dissolved in most organic solvents. Thus, it appears that cross-linking of the latex particles took place. However, after a few days the gel almost disappeared and the latex particles became redispersed in hydrocarbon liquids. This result indicates that there is a measurable ligand exchange between the cross-linked polymeric Zr-salicylate and the free zirconium neodecanoate. From these results, it is concluded that the 1:1 complex of Zr-salicylate is the most preferred. When the reverse addition was performed, gel formation was not observed. The latex particles looked very stable even after the mixture had been heated for several hours. Since gel formation under this drastic condition did not occur, it is reasonable to assume the 1:4 complex is not favored when the reverse addition is performed. Because the Zr salt is in excess during the addition period, the 1:1 complex is favored for two main reasons:

a) after adding the latex to the Zr salt and observing the stability of the latex during a period of 6 months, it was found that the latex was quite stable.

b) measurements of the particle size of the latex before it was added to the Zr salt and then again after the addition showed no increase in the particle size. The particle size measurements were constant even after 6 months.

More proof for the possible formation of the 1:1 complex, was found in the conductivity measurements. The 1:4 complex of (Zr-salicylic acid) had poor solubility in Isopar TM G and did not contribute to a significant increase in the conductivity, while 1:1 or 1:2 or 1:3 ratios caused a high increase in the conductivity due to the solvated carboxylate counter ions of the fatty acid in Isopar TM G. A sample of the gelled latex was centrifuged and after it was washed with Isopar TM G several times, it was redispersed again in Isopar TM G to bring the concentration to about 0.3%. This sample showed a conductivity of $0.2\times10^{-11}$ (ohm.cm)−1. However, when a sample made by the reverse addition was processed in the same manner, it showed a conductivity of $8\times10^{-11}$ (ohm.cm)−1. This suggests that the sample that was made by the reverse addition is the 1:1 complex.

In some cases, the reaction of a metal soap with latices containing small amounts of chelating groups in a hydrocarbon liquid such as Isopar TM G have been determined by spectrophotometric means. The UV spectra of 3-methacryloxy-2,4-pentanedione ($2\times10-4$ M) in isopar TM G show a strong and broad acetylacetone (acac) absorption band at about 281 nm due to the $\pi$-$\pi^*$ transition of the cyclic enol, C. T. Yoffe et. al., Tetrahedron, 18, 923 (1962) and a sharp absorption band at 225nm due to the methacrylate residue. This solution was titrated by adding increment amounts of a solution of zirconium neodecanoate in mineral oil (Mooney Co., obtained as 40% solids in mineral oil) in such a way that the molar concentration of the Zr salt ranged from $0.4\times10-4$ to $2\times10-4$ (mol/liter). After each addition, the solution was heated to 60° C. for five minutes and the U.V. spectrum was measured. As the concentration of the Zr salt increased, the intensity of the acac peak at 281nm decreased and a new distinctive peak at 305nm appeared. When the molar concentrations of the acac-methacrylate and the Zr salt reached 1:1, the acac peak became a minimum and the new peak showed a strong absorption at 311.8nm. The new peak corresponds to the Zr-acac chelate. The chelation reaction between zirconium neodecanoate and a latex of polyethylacrylate containing 1% pendant acac groups attached to the stabilizer polymeric chains was performed under the same conditions as those used with the acac-methacrylate. The UV spectra of the latex alone in Isopar TM G, showed a shoulder in the region between 250nm and 340 nm with no distinctive peaks. As the concentration of the Zr salt was increased, a distinctive peak of 310.4 nm appeared. Addition of more Zr salt only increased the intensity of the peak. The disappearance of the shoulder and the appearance of the new peak at 310.4 nm is an indication of the formation of the Zr-acac chelate. The significance of using the spectrophotometric tool to determine the metal-chelate formation is that it can be used on-line as a means to detect the progress of the chelation reaction before manufacturing of the toners. Table (I) below shows the λmax of the formed metal-chelate groups by reacting a mixture containing zirconium neodecanoate and a latex containing acac groups with different concentrations in Isopar TM G. The acac latex was added to the Zr salt and the mixture was heated at 60° C. for 15 minutes after mixing.

TABLE I

| $C_1\times10^{-4}$M | $C_2\times20^{-4}$M | λmax (nm) |
|---|---|---|
| 2 | 0 | shoulder |
| 1.778 | 0.222 | shoulder |
| 1.6 | 0.4 | 304.4 |
| 1.33 | 0.666 | 307.6 |
| 1 | 1 | 308.4 |
| 0.666 | 1.333 | 310.4 |

$C_1$ is the concentration of the acac-latex based on the acac content.
$C_2$ is the concentration of the zirconium neodecanote.

In order to determine if the chelation reaction between zirconium neodecanoate and a latex containing acac groups attached to the core part of the latex would perform in the same manner, the experiment of Table (I) was repeated using a latex containing about 10% of the acac groups in its core. The UV spectra showed no distinctive peaks in the region between 250 nm and 350 nm. This experiment indicated that the reaction between the acac groups and the Zr salt would not take place if the chelating groups are attached to the insoluble polymeric core. This may be due to the inability of the Zr salt to penetrate the insoluble core of the latex.

The spectrophotometric results have been confirmed quantitatively by determining the wt % of a metal absorbed by a latex containing acac groups. The results are summarized in Table (II) below.

TABLE II

| Sample | acac ratio in the latex polymer | acac attach-ment | metal soap | found wt % metal | expected wt % metal |
|---|---|---|---|---|---|
| 1 | none | none | FeLau | 0.11 | 0.00 |
| 2 | 1% | stabilizer | FeLau | 0.36 | 0.30 |
| 3 | 10% | core | FeLau | 0.29 | 0.30 |
| 4 | none | none | ZrNeo | 0.10 | 0.00 |
| 5 | 1% | stabilizer | ZrNeo | 0.39 | 0.50 |
| 6 | 10% | core | ZrNeo | 0.19 | 0.50 |

where FeLau = Fe(laurate)$_3$ prepared as disclosed in the literature
and ZrNeo = Zr(neodecanoate)$_4$
Notes:
1. Samples were heated for 15 minutes at 70° C.
2. The mixture of the latex and the metal soap was centrifuged three times with fresh Isopar TM G.
3. The extracted latex polymer was dried at 0.2 mm & 50° C. for several hours.
4. The accuracy of the measured metal content may be within 20% of the correct value. However, the relative error should be constant for all the measured values.

From the above Table, it appeared that the wt % of the metal absorbed by a non-chelating latex is very small compared to that absorbed by a latex containing chelating groups. Also, the amount of metal absorbed by a latex with attached acac groups to the core is much less than that absorbed by a latex with attached acac groups to the stabilizer.

Liquid Toner Conductivities

Conductivity of a liquid toner has been well established in the art as a measure of the effectiveness of a toner in developing electrophotographic images. A range of values from $1.0\times10^{-11}$ mho/cm to $10.0\times10^{-11}$ mho/cm has been disclosed as advantageous in U.S. Pat. No. 3,890,240. High conductivities generally indicate inefficient association of the charges on the toner particles and is seen in the low relationship between current density and toner deposited during development. Low conductivities indicate little or no charging of the toner particles and lead to very low development rates. The use of charge director compounds to ensure sufficient charge associated with each particle is a common practice. There has, in recent times, been a realization that even with the use of charge directors there can be much unwanted charge situated on charged species in solution in the carrier liquid. Such charge produces inefficiency, instability and inconsistency in the development. We have found (and have disclosed in our copending case U.S. Pat. No. 4,925,766, filed Dec. 2, 1988, titled LIQUID ELECTROPHOTOGRAPHIC TONERS) that at least 40% and preferably at least 80% of the total charge in the liquid toner should be situated and remain on the toner particles.

Suitable efforts to localize the charges onto the toner particles and to ensure that there is substantially no migration of charge from those particles into the liquid, and that no other unwanted charge moieties are present in the liquid, give substantial improvements. As a measure of the required properties, we use the ratio between the conductivity of the carrier liquid as it appears in the liquid toner and the conductivity of the liquid toner as a whole. This ratio must be less than 0.6 preferably less than 0.4 and most preferably less than 0.3. Prior art toners examined have shown ratios much larger than this, in the region of 0.95.

Carrier Liquids

Carrier liquids used for the liquid toners of this invention are chosen from non-polar liquids, preferably hydrocarbons, which have a resistivity of at least $10^{11}$ ohm-cm and preferably at least $10^{13}$ ohm-cm, a dielectric constant less than 3.5 and a boiling point in the range 140° C. to 220° C. Aliphatic hydrocarbons such as hexane, cyclohexane, iso-octane, heptane, and isododecane, and commercially available mixtures such as Isopars TM G, H, K, and L of Exxon are suitable. However aromatic hydrocarbons, fluorocarbons, and silicone oils may also be used.

Colorants

A wide range of pigments and dyes may be used. The only criteria is that they are insoluble in the carrier liquid and are capable of being dipersed to a particle size below about a micron in diameter. Examples of preferred pigments:

Sunfast magenta
Sunfast blue (1282)
Benzidine yellow (All Sun Co.)
Quinacridone Carbon black (Raven 1250)
Carbon black (Regal 300)
Perylene Green

Particle Size Measurements

The latex organosol particle size and liquid toner particle size were determined with the Coulter N4 Sub-Micron Particle Size Analyzer. The N4 utilizes the light scattering technique of photon correlation spectroscopy to measure the small frequency shift in the scattered light compared with the incident laser beam, due to particle translation or diffusion. (See B. Ch. "Laser Scattering", Academic Press, New York (1974) 11A).

The diffusion coefficient is the measured parameter which was related to the particle size. The N4 can accurately determine size and estimate size distributions for particles in the range 25–2500 nm. diameter.

Conductivity Measurement

The liquid toner conductivity (k) was determined experimentally using a parallel plate capacitor type arrangement. The capacitor plate area is large compared to the distance between plates so that an applied voltage results in a uniform electric field ($E=V/d$; $V$=applied voltage; $d$=plate separation) applied to a dispersion when placed between the plates. The measurement consisted of monitoring the current (Keithley 6/6 Digital Electrometer) after the voltage was applied to the liquid toner ("Progress in Organic Coatings", Kitahara 2, 81 (1973)). Typically the current shows an exponential decay during measurement time. This behavior was due to the sweeping out of charged ions and charged toner particles.

The toner conductivity is determined from $i_o$ which is the current determined by extrapolation to time 0 ($t=O$) for initial conditions. The conductivity k is calculated from $k=i_o/AE$ where A is the area of the capacitor plate. The units in conductivity are in pmho/cm. Toner electrical measurements were also carried out using a Conductance Meter model 627 (Scientific Instruments). Typical conductivity values for liquid toners are in the range of 20–200 pmho/cm.

Preparation of Liquid Toner

An example of a suitable method and apparatus to prepare the liquid toner.

| Item | Description of Component |
|---|---|
| A | Monovalent Carboxylate |
| B | Metal Soap |
| C | Organosol |
| D | Hydrocarbon Solvent |
| E | Pigment |

Into a clean container are added items A and B where they are mixed well. Once items A and B are dissolved/dispersed well, add items C, and D and mix well. While mixing gently, item E is added with continued mixing for 10 minutes. The mixture is placed on a mixer, i.e., Cowles dissolver, for 20 minutes. After mixing, it is placed in a sandmill or other suitable mill and charged with 20–30 mesh sand. The mill is run for a desired length of time to obtain desired particle size.

Example of Application to Electrophotographic Imaging

A description of suitable apparatus and processes in which the toners of this invention may be used to develop an electrophotographic image is to be found in our U.S. Pat. No. 4,728,983,which is hereby incorporated by reference, One embodiment of the present invention is as follows:

An organic photoreceptor comprising 40 parts of bis-(N-ethyl-1,2-benzocarbazol-5-yl)phenylmethane (BBCPM) as disclosed in U.S. Pat. No. 4,361,637, 50 parts of binder Makrolon TM 5705, 9.5 parts Vitel TM polyester, and 0.5 parts of an infrared sensitizing dye (a heptamethinecarbocyanine with a sensitizing peak at a wavelength of 825 nm, an electron accepting dye) was coated as a charge generating layer at about a 10 micron thickness on an aluminized 5 mil thick polyester substrate.

This was topcoated with a release layer comprising a 1-½% solution of Syl-off TM 23 (a silicone polymer available from Dow Corning Corporation) in heptane, and dried.

The photoreceptor was positively charged, exposed to a first half-tone separation image with a suitable imaging light and developed with magenta toner using an electrode spaced 510 microns away for a dwell time of 1 second with a toner flow rate of 500 ml/min. The electrode was electrically biased to 300 volts to obtain the required density without perceptible background. The excess carrier liquid dried from the toner image. This magenta imaged photoreceptor was recharged, exposed to a second half-tone separation image with a suitable imaging light and developed with yellow toner under the same conditions as for the first image and dried. Again the photoreceptor was charged, exposed to a third halftone separation image with a suitable imaging light source, developed, with cyan toner, and dried.

A receptor sheet comprising a sheet of 3 mil phototypesetting paper coated with 10% Litania pigment dispersed in Primacor TM 4983 to a thickness of 2 mils was laminated against the photoreceptor with a roller pressure of 5 pounds/linear inch and temperature of 100° C. at the surface. Upon separating the paper receptor, the complete image was found to be transferred and fixed to the paper surface without distortion.

The finished full color image showed excellent halftone dot reproduction at 150 line screen of from 3 to 97% dots. The toners produced excellent image density of 1.4 reflectance optical density (ROD) for each color. The toners also gave excellent overprinting with trapping of between 85–100 % without loss of detail of the individual dots. The background was very clean and there was no evidence of unwanted toner deposit in the previously toned areas. The final image was found to be rub resistant and nonblocking.

Measurement of % TRAP

Full color halftone images using cyan, magenta, yellow, and black (CMYK) pigments require specific overprinting or trap characteristics to give secondary colors and grey balance. Several factors contribute to trap variations in lithography including ink transfer characteristics, ink color, thickness and transparency, as well as particle size. Liquid toner technology shows trap variation in many ways similar to conventional printing due to the nature of the colorants. However, exposing and developing over previously deposited layers is significantly different than the lithographic process of ink transfer due to ink rheologic properties. Therefore, it is necessary to evaluate trap not only in terms of ink characteristics such as color and transparency but also in relation to the deposition process.

$$\% \text{ Trap } A/B = \left| \frac{(TOD\ A/B - TOD\ B)) \times 100}{TOD\ A} \right|_{A\ Filter}$$

VOLTAGE TRAP $$\% \text{ Voltage Trap} = \frac{\text{V final (over toned layer)}}{\text{V final (photoconductor)}} \times 100$$

Voltage trap is defined as the ratio of discharge voltage on a photoreceptor exposed through the toner compared to an untoned area.

Example 1

The effect of added Na Stearate to organosol/chelate liquid toners is found to increase the toner particle mobility. The toner mobility values were measured with the DELSA TM 440 light scattering device (Coulter Electronics). The effect of increased toner mobility is to reduce the "clouding artifact" which is an artifact that results in a high degree of background adjacent to an imaged area.

The following samples were milled on an Igarashi mill. Black was milled for 1 hour at 1000 rpm and magenta was milled for 90 minutes at 2000 rpm. After milling the toner was diluted; black diluted to 0.5% solids and magenta to 0.4% solids.

| Mill base | | Components |
|---|---|---|
| Black 1 | 76.8 | grams Regal 300 carbon black |
| | 1956.69 | grams organosol (15.7% solids - solvent is Isopar G) |
| | 153.6 | grams Foral TM 85 (25% solids - solvent Isopar TM G) |
| | 49.15 | grams Zr Ten Cem (40% solids - solvent is VMP naptha |
| | 1012.91 | grams Ispoar TM G |
| Black 2 | | Mix together first: |
| | 49.15 | grams Zr Ten Cem (40% solids - solvent is VMP naptha) |

-continued

| | | |
|---|---|---|
| | 1.23 | grams NaStearate |
| | | Then add: |
| | 76.8 | grams Regal 300 carbon black |
| | 1956.69 | grams organosol (15.7% solids - solvent is Isopar TM G) |
| | 153.6 | grams Foral TM 85 (25% solids - solvent Isopar TM G) |
| | 1012.91 | grams Isopar TM G |
| Black 3 | | Mix together first: |
| | 49.15 | grams Zr Ten Cem (40% solids - solvent is VMP naptha) |
| | 76.8 | grams Regal 300 carbon black |
| | 1956.69 | grams organosol (15.7% solids - solvent is Isopar TM G) |
| | 153.6 | grams Foral TM 85 (25% solids - solvent Isopar TM G) |
| | 1012.91 | grams Isopar TM G |
| | | Then add: |
| | 1.23 | grams NaStearate |
| Magenta 1 | 36.13 | grams Sun Red pigment 234-0077 (C.I. pigment red 48) |
| | 856.30 | grams organosol (15.7% solids - solvent is Isopar TM G |
| | 21.10 | grams Zr Ten Cem (40% solids - solvent is VMP naptha) |
| | 507.57 | grams Isopar TM G |
| Magenta 2 | | Mix together first: |
| | 21.10 | grams Zr Ten Cem (40% solids - solvent is VMP naptha) |
| | 0.53 | grams NaStearate |
| | | Then add: |
| | 36.13 | grams Sun Red pigment 234-0077 (C.I. pigment red 48) |
| | 856.30 | grams organosol (15.7% solids - solvent is Isopar TM G |
| | 507.57 | grams Isopar TM G |

Data:

| Toner | Mobility (um-cm/V sec) | Clouding Artifact |
|---|---|---|
| Black 1 | 0.045 | Yes |
| Black 2 | 0.130 | No |
| Black 3 | 0.060 | No |
| Mgenta 1 | 0.042 | Yes |
| Magenta 2 | 0.115 | No |

As can be seen by the above results the Na additive has a large effect on the toner properties and this effect is most evident when the additive is used in the mixture prior to milling as opposed to post mill addition. The above trends are also observed with K, Li, and NH4 carboxylates.

Example 2

It has also been found that different monovalent carboxylates are effective in increasing ink film conductance which improves overprintability and color quality characteristics. This example also contains comparative tone samples between monovalent and divalent carboxylate additives.

Each mill base was milled on an Igarashi mill for 90 minutes at 2000 rpm. After milling the concentrated magenta toner was diluted to a total volume of 2500 grams with Isopar TM G to obtain 0.4% solids and a 4/1 organosol to pigment ratio. The toner was deposited over itself to measure voltage and toner trap through the same toner.

| Mill base | | Components |
|---|---|---|
| Magenta 3 | 3.74 | grams Sun Red pigment 234-0077 (C.I. pigment red 48) |
| | 2.50 | grams Quindo Magenta pigment (C.I. pigment red 122) |
| | 162.08 | grams organosol (15.7% solids - solvent is Isopar TM G |
| | 2.0 | grams Zr Ten Cem (40% solids - solvent is VMP naptha) |
| | 89.69 | grams Isopar TM G |
| Magenta 4 | | Mix together: |
| | 1.90 | grams Zr Ten Cem (40% solids - solvent is VMP naptha) |
| | 0.10 | grams Sodium Stearate |
| | | Then add: |
| | 3.74 | grams Sun Red pigment 234-0077 (C.I. pigment red 48) |
| | 2.50 | grams Quindo Magenta pigment (C.I. pigment red 122) |
| | 162.08 | grams organosol (15.7% solids - solvent is Isopar TM G) |
| | 89.69 | grams Isopar TM G |
| Magenta 5 | | Mix together: |
| | 1.90 | grams Zr Ten Cem (40% solids - solvent is VMP naptha) |
| | 0.10 | grams Potassium Palmitate |
| | | Then add: |
| | 3.74 | grams Sun Red pigment 234-0077 (C.I. pigment red 48) |
| | 2.50 | grams Quindo Magenta pigment (C.I. pigment red 122) |
| | 162.08 | grams organosol (15.7% solids - solvent is Isopar TM G) |
| | 89.69 | grams Isopar TM G |
| Magenta 6 | | Mix together: |
| | 1.90 | grams Zr Ten Cem (40% solids - solvent is VMP naptha |
| | 0.10 | grams Zinc Stearate |
| | | Then add: |
| | 3.74 | grams Sun Red pigment 234-0077 (C.I. pigment red 48) |
| | 2.50 | grams Quindo Magenta pigment (C.I. pigment red 122) |
| | 162.08 | grams organosol (15.7% solids - solvent is Isopar TM G) |
| | 89.69 | grams Isopar TM G |
| Magenta 7 | | Mix together: |
| | 1.90 | grams Zr Ten Cem (40% solids - solvent is VMP naptha) |
| | 0.10 | grams Magnesium Stearate |
| | | Then add: |
| | 3.74 | grams Sun Red pigment 234-0077 (C.I. pigment red 48) |
| | 2.50 | grams Quindo magenta pigment (C.I. pigment red 122) |
| | 162.08 | grams organosol (15.7% solids - solvent is Isopar TM G) |
| | 89.69 | grams Isopar TM G |
| Magenta 8 | | Mix together: |
| | 1.90 | grams Zr Ten Cem (40% solids - solvent is VMP naptha) |
| | 0.10 | grams Calcium Stearate |
| | | Then add: |
| | 3.74 | grams Sun Red pigment 234-0077 (C.I. pigment red 48) |
| | 2.50 | grams Quindo Magenta pigment (C.I. pigment red 122) |
| | 162.08 | grams organosol (15.7% solids - solvent is Isopar TM G) |
| | 89.69 | grams Isopar TM G |
| Magenta 9 | | Mix together: |
| | 1.90 | grams Zr Ten Cem (40% solids - solvent is VMP naptha) |
| | 0.10 | grams Ammonium Acetate |
| | | Then add: |
| | 3.74 | grams Sun Red pigment 234-0077 (C.I. pigment red 48) |
| | 2.50 | grams Quindo magenta pigment (C.I. pigment red 122) |
| | 162.08 | grams organosol (15.7% solids - solvent is Isopar TM G |
| | 89.69 | grams Isopar TM G |
| Magenta 10 | | Mix together: |
| | 1.90 | grams Zr Ten Cem (40% solids - solvent is VMP naptha) |

-continued

| | | |
|---|---|---|
| | 0.10 | grams Lithium Stearate |
| | | Then add: |
| | 3.74 | grams Sun Red pigment 234-0077 (C.I. pigment red 48) |
| | 2.50 | grams Quindo Magenta pigment (C.I. pigment red 122) |
| | 162.08 | grams organosol (15.7% solids - solvent is Isopar TM G) |
| | 89.69 | grams Isopar TM G |
| Magenta 11 | | Mix together: |
| | 1.90 | grams Zr Ten Cem (40% solids - solvent is VMP naptha) |
| | 0.10 | grams Aluminum Stearate |
| | | Then add: |
| | 3.74 | grams Sun Red pigment 234-0077 (C.I. pigment red 48) |
| | 2.50 | grams Quindo Magenta pigment (C.I. pigment red 122) |
| | 162.08 | grams organosol (15.7% solids - solvent is Isopar TM G) |
| | 89.69 | grams Isopar TM G |

| Data: Toner | Density Trap | Voltage Trap |
|---|---|---|
| Magenta 3 | 86 | 84 |
| Magenta 4 | 93 | 96 |
| Magenta 5 | 93 | 94 |
| Magenta 6 | 85 | 87 |
| Magenta 7 | 87 | 89 |
| Magenta 8 | 87 | 90 |
| Magenta 9 | 93 | 92 |
| Magenta 10 | 92 | 95 |
| Magenta 11 | 90 | 89 |

These data show that improved trap or overprinting is obtained by the addition of various additives. Also a further improvement is shown with monovalent carboxylates (e.g. Magenta 4, 5, 9 and 10) compared to samples containing divalent carboxylates (Magenta 6, 7, 8 and 11)

Example 3

Varying the amount of sodium stearate present in a toner and comparing the uniformity of a printed toner and the overprint values. Samples were milled on an Igarashi mill at 1000 rpm for 1 hour. After milling the samples were diluted to 0.5% solids using Isopar TM G. All imaging of the toner was performed as previously described.

| General mill base formulation: | | |
|---|---|---|
| mix together | 1.97 | grams Zr. Ten Cem (40% solids - solvent is VMP naptha) |
| | — | grams Sodium Stearate |
| add to above mixture: | | |
| | 154.5 | grams organosol (15.7% solids - solvent is Isopar TM G) |
| | 6.14 | grams Regal 300 carbon black pigment |
| | — | grams Foral TM 85 (25% solids in Isopar TM G solvent) |
| | — | grams Isopar TM G |

| Mill base | Grams Sodium Stearate | Percent Sodium Stearate to Zr Ten Cem | Grams Foral TM 85 | Grams Isocar TM G |
|---|---|---|---|---|
| Black 4 | 0.25 | 12.7 | 12.29 | 81.0 |
| Black 5 | 0.174 | 8.8 | 12.29 | 81.0 |
| Black 6 | 0.098 | 5.0 | 12.29 | 81.0 |
| Black 7 | 0.049 | 2.5 | 12.29 | 81.0 |
| Black 8 | 0.025 | 1.3 | 12.29 | 81.0 |
| Black 9 | 0.0 | 0.0 | 12.29 | 81.0 |

-continued

| Data: Toner | Uniformity Within Proof | Uniformity Within Patch | Overprint Value Black over Cyan | *Conductivity |
|---|---|---|---|---|
| Black 4 | 0.026 | 0.013 | 0.24 | 83 |
| Black 5 | 0.05 | 0.029 | 0.34 | 90 |
| Black 6 | 0.045 | 0.022 | 0.33 | 69 |
| Black 7 | 0.07 | 0.03 | 0.51 | 42 |
| Black 8 | 0.085 | 0.05 | 0.59 | 46 |
| Black 9 | 0.12 | 0.09 | 0.66 | 34 |

*Conductivity values are E-12

Uniformity Within Proof-Uniformity Within Patch

Density measurements are taken using a Gretag D186 densitometer with narrow band filter set. Five readings are obtained on a rectangular patch. One reading is read in each corner and one in the middle and the range is reported. Uniformity within proof readings are taken from a minimum of 9 patches located on the whole imaging proof. Five readings are read on each 9 patches and the range is reported.

Overprint Value - Black over Cyan

The samples were prepared by depositing a cyan toner on a Nesa glass electrode and wiping away half of the toner. The black toner was then plated out for 0.5 seconds and the density value at both the area on top of the previous color and the area where only black was present was read. The difference was recorded. The lower value indicates the ability of the black toner to overlay the previous color. As seen from the data, the presence of sodium stearate is beneficial to the overprinting of the cyan toner. The cyan toner used in this example was prepared by Sandmilling the following formulation.

| Mill base | | Components |
|---|---|---|
| Cyan 1 | | Mix together: |
| | 44.6 | grams Zr Ten Cem (40% solids - solvent is VMP naptha) |
| | 0.28 | grams Sodium Stearate |
| | | then add: |
| | 68.37 | grams G.S. Cyan (Sun Chemical) |
| | 1.3 | grams carbon black pigment |
| | 2262.53 | grams organosol (15.4% solids - solvent is Isopar TM G) |
| | 1512.13 | grams Isopar TM G |

We claim:

1. A liquid electrophotographic toner comprising a carrier liquid, a pigment particle, and a coordinated association of steric stabilizer and charge directing moiety, said liquid toner being characterized by said charge directing moiety having bonded thereto a monovalent alkali metal cation or ammonium cation.

2. The toner of claim 1 wherein said monovalent alkali metal cation or ammonium cation is ionically bonded to said charge directing moiety.

3. The liquid toner of claim 2 wherein said alkali metal or ammonium cation is present in a molar ratio of at least 0.05% to said charge directing moiety.

4. The liquid toner of claim 3 wherein said alkali metal cation or said ammonium cation is present in a molar ratio of from 0.01 to 50% with respect to said charge directing moiety.

5. The liquid toner of claim 2 wherein said alkali metal cation or said ammonium cation is present in a molar ratio of from 0.01 to 50% with respect to said charge directing moiety.

6. The liquid toner of claim 1 wherein said alkali metal cation or said ammonium cation is present in a molar ratio of from 0.1 to 15% with respect to said charge directing moiety.

7. The liquid toner of claim 1 wherein said alkali metal cation or said ammonium cation is present in a molar ratio of from 0.1 to 15% with respect to said charge directing moiety.

8. The liquid toner of claim 7 wherein said alkali metal cation or said ammonium cation is present in a molar ratio of from 0.01 to 50% with respect to said metal of said metal soap.

9. The liquid toner of claim 8 wherein said alkali metal cation or ammonium cation is present as a carboxylate, sulfonate, hydride, carbonate or hydroxide.

10. The liquid toner of claim 9 wherein said alkali metal cation or said ammonium cation is present in a molar ratio of from 0.1 to 15% with respect to said metal of said metal soap.

11. A liquid electrophotographic toner comprising a non-polar carrier liquid having a dispersion therein of toner particles comprising a pigment particle having thermoplastic polymeric particles about the surface of said pigment particle, said polymeric particles have copolymeric steric stabilizer groups adhered to the surfaces of said polymeric particles, said steric stabilizer having coordinating moieties adhered thereto, said coordinating moieties coordinately bonded to metal soaps, and said metal soap having a charge enhancing monovalent alkali metal cation or ammonium cation bonded thereto.

12. The toner of claim 11 wherein said monovalent alkali metal cation or ammonium cation is ionically bonded to said metal of said metal soap or to an oxygen atom bonded to said metal of said metal soap.

13. The liquid toner of claim 12 wherein said alkali metal or ammonium cation is present in a molar ratio of at least 0.05% to said metal of said metal soap.

14. The liquid toner of claim 13 wherein said alkali metal cation or said ammonium cation is present in a molar ratio of from 0.01 to 50% with respect to said metal of said metal soap.

15. The liquid toner of claim 12 wherein said alkali metal cation or said ammonium cation is present in a molar ratio of from 0.01 to 50% with respect to said metal of said metal soap.

16. The liquid toner of claim 11 wherein said alkali metal cation or said ammonium cation is present in a molar ratio of from 0.01 to 50% with respect to said metal of said metal soap.

17. A process for preparing a liquid electrophotographic toner comprising mixing a carrier liquid, pigment particle, and a coordinated association of a steric stabilizer and charge direction moiety, said process further comprising adding a monovalent alkali metal cation compound or ammonium compound to said carrier liquid, pigment particle and coordinated association to bond said monovalent alkali metal cation or ammonium cation to said charge direction moiety.

18. The process of claim 17 wherein said charge directing moiety of said coordinated association comprises a transition metal and a soap.

19. The process of claim 18 wherein said transition metal has a Brönstead acid hydrogen bonded thereto or to an oxygen atom bonded to said transition metal.

20. The process of claim 19 wherein said monovalent alkali metal compound or ammonium compound comprises a carboxylate, sulfonate, hydride, carbonate or hydroxide.

21. A liquid electrophotographic toner comprising a non-polar carrier liquid, a pigment particle, and a coordinated association of a steric stabilizer and charge directing moiety, said liquid toner being characterized by said charge directing moiety having bonded thereto a monovalent alkali metal cation or ammonium cation.

22. A liquid electrophotographic toner comprising a non-polar carrier liquid, a pigment particle, and a coordinated association of a steric stabilizer and charge transport moiety, said liquid toner being characterized by said charge directing moiety having bonded thereto a monovalent alkali metal cation or ammonium cation, and said steric stabilizer being soluble in said non-polar carrier liquid.

* * * * *

UNITED STATES PATENT AND TRADEMARK OFFICE

CERTIFICATE OF CORRECTION

PATENT NO. : 5,302,482

DATED : April 12, 1994

INVENTOR(S) : Mohamed A. Elmasry et al.

It is certified that error appears in the above-indentified patent and that said Letters Patent is hereby corrected as shown below:

Col. 7, line 60, "($Ca^{-2}$)" should be --($Ca^{+2}$)--.

Signed and Sealed this

Fourth Day of October, 1994

*Attest:*

*Attesting Officer*

BRUCE LEHMAN

*Commissioner of Patents and Trademarks*